US007597503B2

(12) United States Patent
Hinding et al.

(10) Patent No.: US 7,597,503 B2
(45) Date of Patent: Oct. 6, 2009

(54) METHOD AND SYSTEM FOR REPAIRING CRACKS IN A PAVED SURFACE

(75) Inventors: Thomas P. Hinding, Guilfurd, CT (US); Carvin Pallenberg, Madison, CT (US)

(73) Assignee: Rite Way Crack Repair LLC, Saratoga Springs, NY (US)

( * ) Notice: Subject to any disclaimer, the term of this patent is extended or adjusted under 35 U.S.C. 154(b) by 0 days.

(21) Appl. No.: 11/696,519

(22) Filed: Apr. 4, 2007

(65) Prior Publication Data

US 2008/0247821 A1 Oct. 9, 2008

(51) Int. Cl.
*E01C 11/24* (2006.01)

(52) U.S. Cl. ..... 404/75; 404/94

(58) Field of Classification Search ..... 404/75, 404/107, 94

See application file for complete search history.

(56) References Cited

U.S. PATENT DOCUMENTS

| | | | | | |
|---|---|---|---|---|---|
| 3,932,051 | A * | 1/1976 | Cleary | 404/82 |
| 3,993,412 | A * | 11/1976 | Drane | 404/28 |
| 4,113,401 | A * | 9/1978 | McDonald | 404/75 |
| 4,897,302 | A * | 1/1990 | Bull | 442/395 |
| 5,185,013 | A * | 2/1993 | Martin | 52/514 |
| 5,464,304 | A * | 11/1995 | Dittmar | 404/75 |
| 6,291,368 | B1 * | 9/2001 | Lee | 442/6 |
| 6,450,729 | B1 * | 9/2002 | Clapp | 404/75 |
| 7,168,887 | B1 * | 1/2007 | Rossi | 404/75 |
| 2003/0215603 | A1 * | 11/2003 | Lee | 428/134 |
| 2004/0120765 | A1 | 6/2004 | Jones, IV et al. | |
| 2006/0123736 | A1 | 6/2006 | Futterman | |

OTHER PUBLICATIONS

Eternabond website http://web.archive.org/web/20060311111434/www.eternabond.com (http://web.archive.org/web/20060311111853/www.eternabond.com/faq.htm, http://web.archive.org/web/20060311112356/www.eternabond.com/tech/WebSeal.pdf; http://web.archive.org/web/20060311111539/www.eternabond.com/detail.asp?id=ebwbs; http://web.archive.org/web/20060311.*

* cited by examiner

*Primary Examiner*—Raymond W Addie
(74) *Attorney, Agent, or Firm*—Nixon Peabody LLP

(57) ABSTRACT

The present invention relates to a method of repairing a crack in a paved surface. This method involves applying a water-tight tape over a crack in a paved surface to cover the crack and form a first layer. The tape is applied with an adhesive. The first layer is contacted with a first liquid acrylic adhesive. The first layer is covered with a polyester fabric to form a second layer that adheres to the first layer. The polyester fabric is impregnated with a second liquid acrylic adhesive. A fiberglass sheet is adhered to at least a portion of the second layer and to the paved surface beyond edges of the second layer to form a transition layer over the edges. Also disclosed is a system for repairing a crack in a paved surface.

14 Claims, 3 Drawing Sheets

METHOD AND SYSTEM FOR REPAIRING CRACKS IN A PAVED SURFACE

FIELD OF THE INVENTION

The present invention is directed to a method and system for repairing cracks in a paved surface.

BACKGROUND OF THE INVENTION

Tennis courts, basketball courts, volleyball courts, running tracks, and other recreational surfaces, particularly paved concrete or asphalt surfaces, are known to develop damaging cracks over time. Cracks in these types of paved surfaces tend to be most pronounced on outdoor surfaces in climates with freeze-thaw cycles caused by large variations in temperature throughout the year. The formation of small hairline cracks can quickly develop into larger cracks when water filters into the crack and freezes during colder temperatures. The pressure created by ice in a crack can cause larger separations which render the paved surface uneven. A cracked or uneven paved surface, particularly a paved surface that is used for recreational purposes, can create a hazard, especially during competitive activity. A cracked or uneven surface can also impact the trajectory of a ball, rendering the surface unsuitable for its intended use. If cracks are left without repair the entire surface can be damaged, requiring replacement of large portions of or even the entire surface. Thus, development of cracks in paved surfaces presents a continuous maintenance problem.

Current methods of repairing cracks in paved surfaces used for recreational and other purposes involve cleaning out the crack of loose debris and filling the crack with a fill material that hardens to form a surface which is level with the surrounding surface. This method is much less expensive than resurfacing an entire section of the pavement. However, filling the crack with a fill material provides only a temporary repair. Moisture can seep into small gaps between the fill material and the crack and pressure caused by freezing and thawing can cause the crack to expand.

Other methods of repairing cracks in a paved surface employ a slip-sheet method, which involves the application of multiple layers of material over a crack or crevice, with at least some of the layers being allowed to slip against each other (i.e., the layers are not adhesively in contact with one another). The slip-sheet method is intended to alleviate stresses which cause crack formation by allowing movement of the repair patch near the crack. However, the slip-sheet method suffers from heaving, and the formation of bubbles and dead spots at the repair site can render the repaired paved surface uneven.

The present invention is directed to overcoming these and other deficiencies in the art.

SUMMARY OF THE INVENTION

One aspect of the present invention relates to a method of repairing cracks in a paved surface. This method involves applying a watertight tape over a crack in a paved surface to cover the crack and form a first layer. The tape is applied with an adhesive. The first layer is contacted with a first liquid acrylic adhesive. The first layer is covered with a polyester fabric to form a second layer that adheres to the first layer. The polyester fabric is impregnated with a second liquid acrylic adhesive. A fiberglass sheet is adhered to at least a portion of the second layer and to the paved surface beyond edges of the second layer to form a transition layer over the edges.

Another aspect of the present invention relates to a system for repairing cracks in a paved surface. The system includes a watertight tape capable of forming a first layer over a crack in a paved surface and a polyester fabric impregnated with a liquid acrylic capable of forming a second layer that adheres to and covers the first layer. The system also includes a fiberglass sheet capable of adhering to at least a portion of the second layer and to the paved surface beyond edges of the second layer to form a transition over the edges.

The present invention provides an improved system and method for repairing cracks and crevices in a paved surface and preventing their return. The system has the advantage of alleviating stresses in existing cracks to prevent further crack formation. Specifically, a first layer made of a watertight tape is pliable and flexible, and is capable of maintaining these properties under extreme conditions of cold and/or heat. A second layer, formed of polyester is impregnated with an acrylic adhesive and hardens to form a stress mat over the soft, pliable, watertight first layer, which holds the repair system in place on the paved surface, while permitting movement in the underlying surface. A third layer formed of a fiberglass sheet material provides a smooth transition from the layered repair system to the surface of the pavement and adds adhesive strength to the underlying layers.

The system and method of the present invention provide a simple and cost-effective way of maintaining recreational court surfaces by restoring cracked paved surfaces to a smooth and functional state and by preventing existing cracks from further cracking. The present invention is an improvement over slip-sheet methods and systems that cause heaving, bubbling, and/or dead spots.

DETAILED DESCRIPTION OF THE INVENTION

One aspect of the present invention relates to a system for repairing cracks in a paved surface. The system includes a watertight tape capable of forming a first layer over a crack in a paved surface and a polyester fabric impregnated with a liquid acrylic capable of forming a second layer that adheres to and covers the first layer. The system also includes a fiberglass sheet capable of adhering to at least a portion of the second layer and to the paved surface beyond edges of the second layer to form a transition over the edges.

Figure 1:
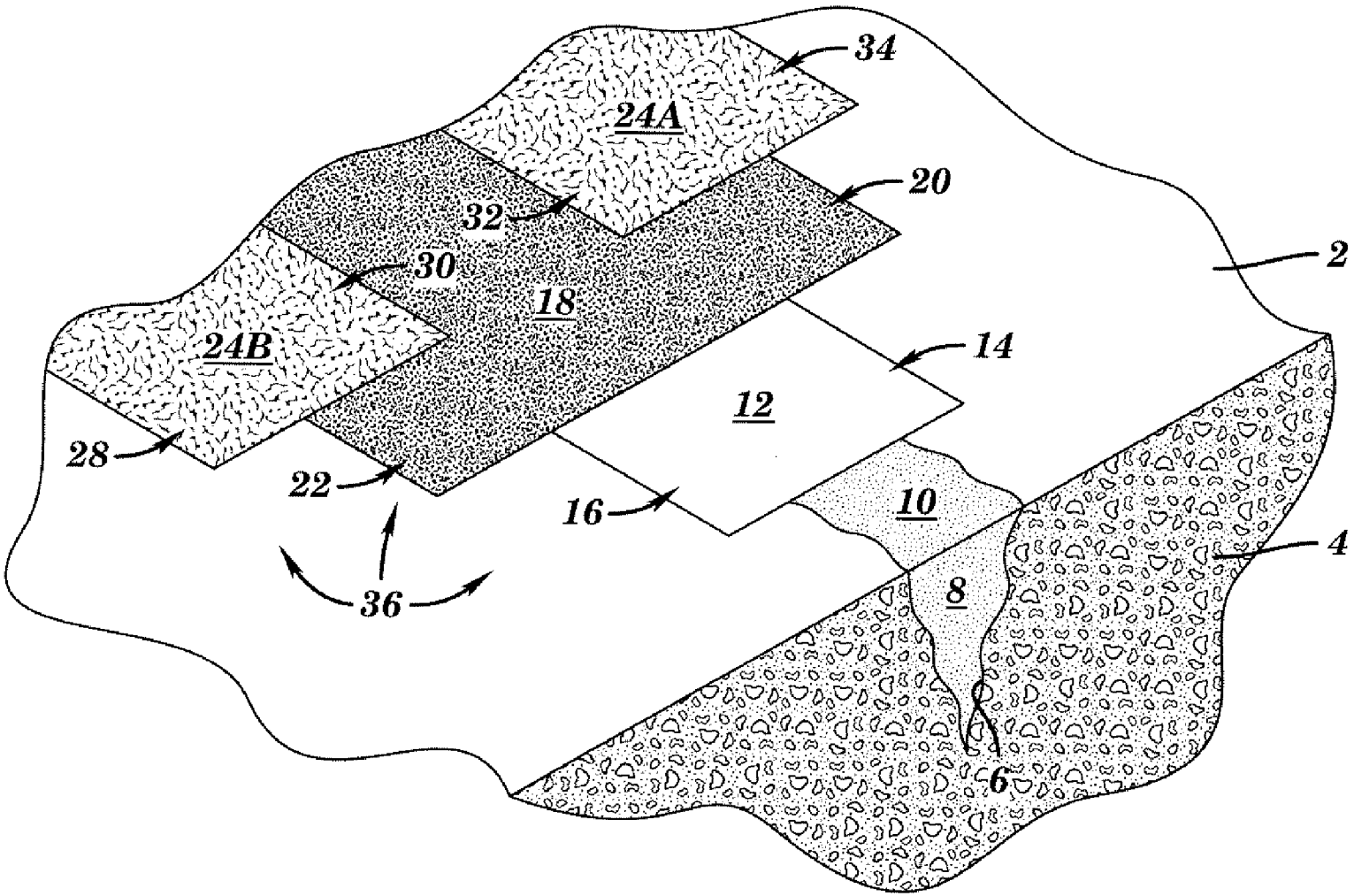
FIG. 1 is an exploded view of a crack in a paved surface repaired according to one embodiment of the method and system of the present invention.

FIG. 1 illustrates one embodiment of the crack-repair system of the present invention. System 36 is applied to paved surface 2, which is supported by pavement 4, to repair crack 6. Paved surface 2 and pavement 4 are formed of any of a variety of pavement materials including, without limitation, asphalt and concrete materials. Other pavement materials which are subject to cracking may also be repaired by the system and method of the present invention. Crack 6 is formed in paved surface 2 and penetrates pavement 4 to a certain depth. The depth of crack 6 may vary from a shallow surface crack which extends only a short distance into pavement 4 to a more penetrating crack which extends deeply into and/or through pavement 4. In the embodiment illustrated in FIG. 1, crack 6 has been filled with fill material 8, which hardens to form fill material surface 10 which is level with paved surface 2.

System 36 has first layer 12, second layer 18, and third layers 24A and 24B.

First layer 12 has lateral edges 14 and 16 which span the width of crack 6 and extend beyond the width of crack 6 to paved surface 2. First layer 12 is a watertight tape that remains flexible and pliable in both cold and hot temperature climates. The flexibility and pliability of first layer 12 permits a certain degree of movement in pavement 4 and paved surface 2 without damaging the watertight characteristics of first layer 12. By watertight, it is meant that first layer 12 is impermeable to water and other solvent based coatings which may come into contact with first layer 12. Preventing the seepage of water into crack 6 eliminates further cracking and damage to paved surface 2 created by a cycle of freezing and thawing of water in crack 6. A suitable watertight tape for first layer 12 is WebSeal™ (Eternabond, Inc., Hawthorn Woods, Ill.), which has the ability to remain flexible at temperatures as low as about −70° F. to more than 200° F. Other watertight materials which are flexible and pliable at a wide range of temperatures may also be used. In a preferred embodiment, first layer 12 has a fabric backing on the surface opposite the surface applied to fill material surface 10 and paved surface 2. The fabric backing helps absorb liquid acrylic applied to first layer 12 and strengthens the adhesive connection of first layer 12 and second layer 18, as described in greater detail below.

First layer 12 may have any dimension (length×width) depending on the size and length of crack 6. Typically, first layer 12 will vary from about 2 inches in width to more than 36 inches in width. First layer 12 preferably has a uniform thickness, which is preferably between about 20-60 mils (~0.5 to about 1.5 mm), more preferably about 20-40 mils, most preferably about 30 mils.

Second layer 18 is a polyester fabric with lateral edges 20 and 22 which extend beyond lateral edges 14 and 16 of first layer 12 to come into contact with paved surface 2. Second layer 18 is thin, having a thickness no greater than about e.g., one-half the thickness of first layer 12. As described in greater detail below, second layer 18 adheres to first layer 12 and forms a rigid mat above first layer 12, while first layer 12 remains pliable and flexible. This permits movement and shifting of crack 6 below while maintaining the structural integrity of second layer 18 above.

Third layers 24A and 24B are thin fiberglass fabric sheets which are brought into adhesive contact with at least a portion of second layer 18 at lateral edges 20 and 22. Third layer 24A has lateral edges 32 and 34 and third layer 24B has lateral edges 28 and 30. Third layers 24A and 24B form a transition from lateral edges 20 and 22 of second layer 18 to paved surface 2. Third layers 24A and 24B have a preferred thickness of about one-half the thickness of second layer 18. Suitable fiberglass sheets are known in the art and are commercially available.

Figure 2:
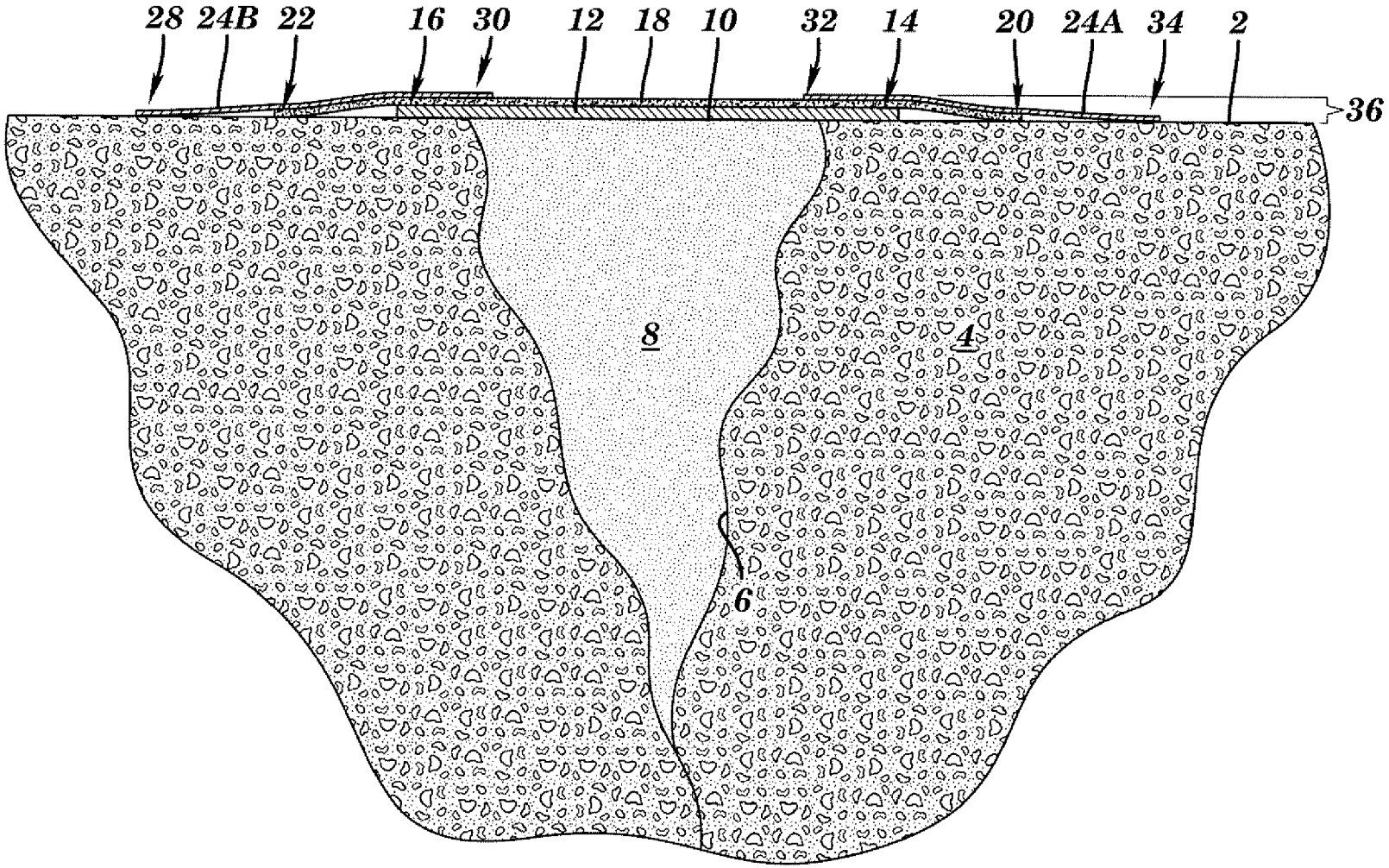
FIG. 2 is a cross-sectional view of a crack in a paved surface repaired according to one embodiment of the system and method of the present invention.

As shown in FIG. 2, first layer 12, second layer 18, and third layers 24A and 24B form a thin layer patch over crack 6.

Another aspect of the present invention relates to a method of repairing cracks in a paved surface. This method involves applying a watertight tape over a crack in a paved surface to cover the crack and form a first layer. The tape is applied with an adhesive. The first layer is contacted with a first liquid acrylic adhesive. The first layer is covered with a polyester fabric to form a second layer that adheres to the first layer. The polyester fabric is impregnated with a second liquid acrylic adhesive. A fiberglass sheet is adhered to at least a portion of the second layer and to the paved surface beyond edges of the second layer to form a transition layer over the edges.

Referring to FIG. 1 in carrying out the method of the present invention, it is preferable to prepare crack 6 by cleaning out any loose debris in crack 6, such as dust, dirt, gravel, crumbled asphalt or concrete, or any other type of loose debris material. This can be accomplished by blowing compressed air into crack 6, by applying a vacuum, or by brushing or sweeping crack 6 to remove the debris. After crack 6 has been cleaned of debris, it is filled with court patch binder material or cement (shown as fill material 8 in FIG. 1). A suitable fill material includes, without limitation, a mixture of sand, cement, and latex. Crack 6 is filled with fill material 8 to a level even or substantially even with surrounding paved surface 2. After fill material 8 dries, it can be scraped, ground, or buffed flush with surrounding paved surface 2.

Paved surface 2 and fill material surface 10 are then cleaned (e.g., broomed or blown) of dust and/or other debris. Paved surface 2 and fill material surface 10 must be dry and preferably at a temperature of about 60° F. or warmer prior to applying first layer 12.

First layer 12 is adhesively applied to fill material surface 10 and paved surface 2 lengthwise along crack 6 to completely cover crack 6 and fill material surface 10. In a preferred embodiment, the adhesive is pre-applied to first layer 12 during manufacturing. When first layer 12 has a pre-applied adhesive, the adhesive is preferably protected by a removable release liner which prevents contamination of the adhesive prior to its use. When first layer 12 is a tape having an adhesive surface protected by a removable release liner, the release liner is removed and first layer 12 is brought into contact with filler material surface 10 and paved surface 2. When first layer 12 does not have an adhesive surface, it can be applied with an adhesive, such as a liquid acrylic, which is applied either directly to fill material surface 10 and paved surface 2 or to the surface of first layer 12 which comes into contact with fill material surface 10 and paved surface 2.

First layer 12 is wide enough to completely cover the width of crack 6 to create a watertight seal at paved surface 2 to prevent seepage of water into crack 6. It is preferable that first layer 12, when brought into adhesive contact with fill material surface 10 and paved surface 2, is completely free of air bubbles between first layer 12 and fill material surface 10 and paved surface 2. The presence of air bubbles can be minimized by pressing down on first layer 12 as it is being applied to fill material surface 10 and paved surface 2 and smoothing it with a roller or other device to bring first layer 12 into complete adhesive contact with fill material surface 10 and paved surface 2. If needed, a small incision can be made in first layer 12 at the site of an air bubble to release the air. After the small incision is made, first layer 12 can then be pressed down into complete contact with fill material surface 10 and paved surface 2.

Figure 3:
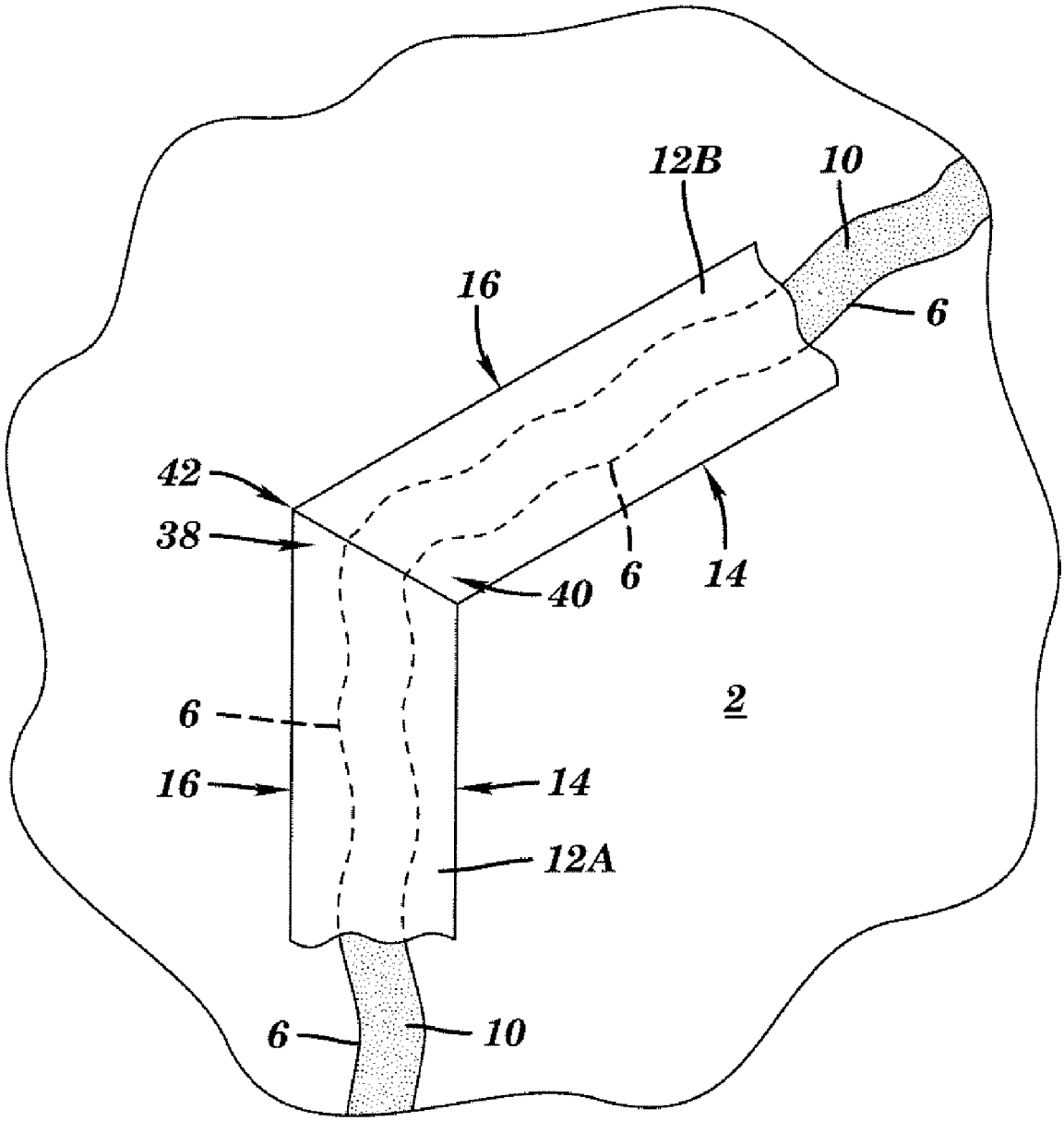
FIG. 3 is a plan view of a paved surface containing a bent crack which is partially covered by two segments of a first layer of the system of the present invention. The two segments of the first layer are mitered at the bend.

When it is in adhesive contact with fill material surface 10 and paved surface 2, first layer 12 should be smooth (i.e., free of wrinkles). When a crack in the paved surface is branched or is non-linear, as illustrated in FIG. 3, it is preferred that two pieces of the first layer, shown as first layers 12A and 12B in FIG. 3, are mitered at adjoining edges 38 and 40 at bend 42 to prevent the formation of wrinkles in the first layer. This same technique can be carried out when applying the additional layers of the system of the present invention to ensure a smooth flat repair.

Referring back to FIG. 1, after first layer 12 is adhesively applied to fill material surface 10 and paved surface 2, a liquid acrylic is applied to the backing (i.e., the surface opposite the surface adhesively applied to fill material surface 10 and paved surface 2) of first layer 12. A fabric backing on first layer 12 provides added adhesion to second layer 18. Suitable liquid acrylics for adhering layers of the system of the present invention are preferably 100% acrylic. Suitable liquid acrylics may include, without limitation, Action-Pave® from Copeland Coating, Inc. (Nassau, N.Y.) and acrylics from Nova Sports U.S.A. (Milford, Mass.) and DecoTurf (Andover, Mass.). If needed, the acrylic can be diluted with a latex to provide a less viscous solution. Application of the liquid acrylic can be carried out with a paint roller, or any other similar or suitable means. Preferably, the liquid acrylic completely covers first layer 12 and extends beyond lateral edges 14 and 16 of first layer 12 onto paved surface 2 for at least a few to several inches beyond lateral edges 14 and 16.

Second layer 18 is centered above first layer 12 and applied over first layer 12 and onto paved surface 2 beyond lateral edges 14 and 16. Second layer 18 is brought into adhesive contact with first layer 12 and paved surface 2 at lateral edges 20 and 22 by an adhesive, preferably a liquid acrylic. In a preferred embodiment the adhesive is applied to first layer 12 and to paved surface 2 near lateral edges 14 and 16 of first layer 12 prior to applying second layer 18. Second layer 18 adheres to first layer 12, as well as paved surface 2 at lateral edges 20 and 22 of second layer 18. Application of second layer 18 onto first layer 12 can be carried out with a roller or other device to ensure that there are no wrinkles or bubbles so that second layer 18 is smooth.

Second layer 18 is impregnated with a liquid acrylic. This can be accomplished by rolling the liquid acrylic with a paint roller or other suitable means onto second layer 18 after second layer 18 has been applied to first layer 12. Liquid acrylic is also applied to paved surface 2 beyond lateral edges 20 and 22 of second layer 18.

Third layers 24A and 24B are applied to at least a portion of second layer 18 to cover at least lateral edges 20 and 22 and to provide a transition from lateral edges 20 and 22 onto paved surface 2. Third layers 24A and 24B adhere to second layer 18 and paved surface 2 by the liquid acrylic previously applied to second layer 18 and paved surface 2. Third layers 24A and 24B are separated, leaving a portion of second layer 18 exposed. As with first layer 12 and second layer 18, third layers 24A and 24B are rolled or pressed smooth to prevent wrinkles and bubbles.

After application of system 36, paved surface 2 can be resurfaced at the repair site with a resurfacing material to overlap and hide the repair. If needed, sand can be applied prior to or with application of the resurfacing material to fill voids where layers of the system of the present invention overlap.

EXAMPLES

The examples below are intended to exemplify the practice of the present invention but are by no means intended to limit the scope thereof.

Example 1

Repair of a Cracked Tennis Court

A crack in a paved tennis court was repaired as follows. The crack was cleaned out with pressurized air to clear out dust and debris. The crack was filled with a sand, cement, and latex mixture (court patch binder). After the mixture dried, the crack was scraped and buffed smooth to the surrounding tennis court surface with a mechanical buffing machine using a 16 grit pad. The surface of the court near the crack was cleaned.

A first layer of 6 inch wide WebSeal™ tape (Eternabond, Inc., Hawthorn Woods, Ill.), which has an adhesive surface protected by a removable release liner, was centered over the filled and cleaned crack. A segment of the removable release liner was removed from the tape and the tape was applied to cover the width of the crack and extend beyond the crack to the tennis court surface. The tape was applied to the entire length of the crack. At significant bends in the crack, the tape was cut at an angle and a new piece of tape was butted up against the tape in the new direction of the crack. The tape was rolled smooth to eliminate air bubbles and wrinkles.

100% pure liquid acrylic was applied with a paint roller over the tape and along the entire length of the tape and beyond the lateral edges onto the tennis court several inches on either side of the tape.

A 20 inch wide piece of polyester fabric was centered and placed over the entire length of the tape and held in place with the liquid acrylic. Liquid acrylic was then applied with a paint roller over the polyester fabric and beyond the lateral edges of the polyester fabric onto the court surface several inches.

Two 9.5 inch wide pieces of fiberglass bonding edge were brought into contact with the lateral edges of the polyester fabric. The bonding edge straddled the lateral edges of the polyester fabric so that half of the bonding edge was in contact with the polyester fabric and half of the bonding edge was in contact directly with the tennis court. The bonding edges were applied along the entire length of the polyester fabric and held in place by the underlying acrylic.

The liquid acrylic was allowed to dry. Two coats of resurfacer were applied over the length of the repaired crack with sand to fill voids where the layers overlap.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.,

What is claimed:

1. A method of repairing a crack in a paved surface, said method comprising:

applying a watertight tape over a crack in a paved surface to cover the crack and form a first layer, wherein the tape is applied with an adhesive;

contacting the first layer with a first liquid acrylic adhesive;

covering the first layer with a polyester fabric to form a second layer that adheres to the first layer;

impregnating the polyester fabric with a second liquid acrylic adhesive, wherein the second layer hardens to form a rigid mat above the first layer; and adhering a fiberglass sheet to at least a portion of the second layer and to the paved surface beyond edges of the second layer to form a transition layer over the edges.

2. The method according to claim 1, wherein the watertight tape is flexible at temperatures as low as about −70° F. to more than 200° F.

3. The method according to claim 1, wherein the watertight tape is pliable.

4. The method according to claim 1, wherein the watertight tape has a thickness of about 1 mm.

5. The method according to claim 1, wherein the watertight tape has a fabric backing.

6. The method according to claim 1 further comprising:

cleaning the crack and the paved surface prior to said applying.

7. The method according to claim 1 further comprising:

filling the crack with a binder or cement material prior to said applying.

8. A system for repairing a crack in a paved surface, said system comprising:

a watertight tape capable of forming a first layer over a crack in a paved surface;

a polyester fabric impregnated with a liquid acrylic capable of forming a second layer that adheres to and covers the first layer, wherein the second layer forms a rigid mat; and a fiberglass sheet capable of adhering to at least a portion of the second layer and to the paved surface beyond edges of the second layer to form a transition over the edges.

9. The system according to claim 8, wherein the watertight tape has an adhesive surface.

10. The system according to claim 9, wherein the watertight tape has a surface opposite the adhesive surface comprising a fabric backing.

11. The system according to claim 8, wherein the watertight tape is flexible at temperatures as low as about −70° F. to more than 200° F.

12. The system according to claim 8, wherein the watertight tape is pliable.

13. The system according to claim 8, wherein the watertight tape has a thickness of about 1 mm.

14. The system according to claim 8, wherein said adhering is carried out with a liquid acrylic.

* * * * *